US007578665B2

(12) United States Patent
Tanigawa et al.

(10) Patent No.: US 7,578,665 B2
(45) Date of Patent: Aug. 25, 2009

(54) DRIVE TRANSMISSION MECHANISM BETWEEN TWO OR MORE ROTARY SHAFTS AND OIL-FREE FLUID MACHINE EQUIPPED WITH THE MECHANISM

(75) Inventors: Shiro Tanigawa, Tama (JP); Takamitsu Nakayama, Yokohama (JP); Yuki Takada, Yokohama (JP)

(73) Assignee: Anest Iwata Corporation, Yokohama-Shi (JP)

( * ) Notice: Subject to any disclaimer, the term of this patent is extended or adjusted under 35 U.S.C. 154(b) by 0 days.

(21) Appl. No.: 11/946,218

(22) Filed: Nov. 28, 2007

(65) Prior Publication Data

US 2008/0181804 A1 Jul. 31, 2008

(30) Foreign Application Priority Data

Nov. 30, 2006 (JP) ..... 2006-323960

(51) Int. Cl.
*F01C 1/18* (2006.01)
*F03C 2/00* (2006.01)

(52) U.S. Cl. ..... 418/206.1; 418/206.6; 417/410.1; 417/420; 310/103; 464/29

(58) Field of Classification Search ..... 418/206.1, 418/206.6; 417/310, 410.1, 410.4, 420; 310/103–105; 74/DIG. 4; 464/29
See application file for complete search history.

(56) References Cited

U.S. PATENT DOCUMENTS 3,150,593 A 9/1964 Funk et al.
4,674,960 A 6/1987 Rando et al.
4,717,322 A 1/1988 Masuda et al.

(Continued)

FOREIGN PATENT DOCUMENTS

EP 0678966 A1 10/1995

(Continued)

OTHER PUBLICATIONS

Extended search report issued in corresponding European patent application No. 07022876.2-1267, dated Mar. 14, 2008.

(Continued)

*Primary Examiner*—Theresa Trieu
(74) *Attorney, Agent, or Firm*—Rossi, Kimms & McDowell, LLP

(57) ABSTRACT

A drive transmission mechanism for transmitting torque between two or more rotary shafts in synchronization with one another without need for lubrication thereby eliminating occurrence of oil contamination, and an oil-free fluid machine equipped with the mechanism, are provided. A magnetic drive disk and a synchronization gear are attached to a rotary shaft connected to a drive motor, a magnetic drive disk and a synchronization gear is attached to a rotary shaft, torque transmission from the rotary shaft to the rotary shaft is carried out in two ways, via the magnetic drive disks and via the synchronization gears and at least one of the synchronization gears is made of plastic material. With the construction, torque transmit load between the rotary shafts via the synchronization gears is decreased, and a plastic gear or gears can be adopted for synchronization gears without reducing life of the gears without need for lubrication oil.

6 Claims, 4 Drawing Sheets

U.S. PATENT DOCUMENTS

| | | | | |
|---|---|---|---|---|
| 4,940,398 | A | 7/1990 | Berges et al. | |
| 5,814,913 | A | 9/1998 | Ojima et al. | |
| 6,964,559 | B2 * | 11/2005 | Behling et al. | 417/410.4 |
| 2008/0131302 | A1 | 6/2008 | Tanigawa et al. | |

FOREIGN PATENT DOCUMENTS

| | | | |
|---|---|---|---|
| GB | 2176848 | A | 1/1987 |
| JP | 2-153285 | A | 6/1990 |
| JP | 6-185483 | A | 7/1994 |
| JP | 61-85483 | A | 7/1994 |
| WO | 9511385 | A | 4/1995 |

OTHER PUBLICATIONS

Extended European Search Report of EP07022875.4-1267, dated Mar. 14, 2008, which corresponds with co-pending related USPG 20080181804.

* cited by examiner

Sectional View along line C-C

Sectional View along line A-A

DRIVE TRANSMISSION MECHANISM BETWEEN TWO OR MORE ROTARY SHAFTS AND OIL-FREE FLUID MACHINE EQUIPPED WITH THE MECHANISM

BACKGROUND OF THE INVENTION

1. Field of the Invention

The present invention relates to a mechanism for transmitting driving force between two or more rotary shafts, specifically to a drive transmission mechanism with which rotors of a dry-sealed mechanical vacuum pump such as Roots type, screw type, and claw type vacuum pump having two or more rotors can be rotated in synchronism with one another without a need for lubrication oil for lubricating the mechanism thereby eliminating occurrence of oil contamination and to an oil-free fluid machine equipped with the mechanism.

2. Description of the Related Art

Fluid machines having two or more counter-rotating meshed lobed rotors accommodated in a rotor casing to expel air trapped in a space between the wall of the casing and the rotor surface by rotating the rotors in synchronization with one another are widely used as vacuum pumps such as roots vacuum pumps, claw vacuum pumps, and screw vacuum pumps.

In these dry mechanical vacuum pumps having two or more lobed rotors, synchronization gears made of metal is usually adapted to allow meshing lobed rotors to rotate in directions opposite to each other. The synchronization gears made of metal are needed to be lubricated with oil, grease, or a solid lubricant, etc. Further, noise occurs due to contact meshing of the synchronization gears.

Lubrication of the synchronization gears is performed with oil, grease, or a solid lubricant, etc. Oil lubrication deteriorates quality of vacuum. In a case of low rotation speed of the rotors, grease may be used, but refilling of grease is not easy. Solid lubricants are not adequate when the gears experience large loads. Grease is poor in friction heat removing performance, and solid lubricants can not remove friction heat.

In a case lubricating oil is reserved in a gear case and supplied to where needed when operating the vacuum pump, there are problems that oil leaks through oil seals of drive shafts of the rotors. Particularly, oil molecules leaked to the pump chamber defuse into the vessel to be evacuated and deteriorate quality of vacuum.

To deal with the problems, it is thinkable to use plastic gears or toothed belt (synchronous belt) in order to transmit driving force without lubricating the synchronization gears. However, there is a disadvantage that large torque can not be transmitted, since the plastic gears and toothed belt are lower in strength as compared with metal gears, resulting in decreased operation life.

In Japanese Laid-Open Patent Application No. 6-185483 (Patent literature 1) is disclosed a dry mechanical vacuum pump of roots type, in which an annular magnet is attached to an end of the drive shaft of a drive motor and to an end of one of the rotary shaft respectively, and a partition member made of electrical insulating material is provided to run in the gap between the outer periphery and inner periphery of the annular magnets so that the pump body side where the annular magnet attached to the rotary shaft exists is separated from the outside of the pump body where the annular magnet attached to the drive shaft of the motor exists. Synchronization gears consisting of a metal gear and a plastic gear for allowing the two rotors to rotate in direction opposite to each other in synchronization with each other are provided at the other ends of the rotary shafts respectively. With this construction, lubricating oil for lubricating the synchronization gears is not needed, oil seals for preventing oil leak from the gear chamber to the pump chamber and for preventing oil leak from the gear chamber to outside are eliminated, and power loss due friction is decreased.

However, with the dry mechanical vacuum pump of roots type disclosed in the patent literature 1, driving torque of the drive motor is transmitted via the annular magnets to one of the rotor and this driving torque is transmitted to the other rotor by way of the synchronization gears consisting of the metal gear and plastic gear. Therefore, when increased driving torque is transmitted from the drive motor to one of the rotors, all of the driving torque is transmitted to the other rotor by way of the synchronization gears and the plastic gear may be fractured or decreased in operation life due to the increased torque.

SUMMARY OF THE INVENTION

Therefore, the object of the invention is to provide a drive transmission mechanism with which torque transmission can be performed between two or more rotary shafts in synchronized counter-rotation with one another without need for lubrication oil thereby eliminating contamination induced by lubrication oil and without reduction of operation life, and an oil-free fluid machine equipped with the drive transmission mechanism.

To attain the object, the present invention proposes a drive transmission mechanism for transmitting torque between two or more rotary shafts supported parallel to one another for rotation in synchronization with one another; wherein magnetic drive disks, each being composed of a magnet carrier disk made of nonmagnetic material and having a plurality of magnets arranged on the magnet carrier disk circumferentially at equal spacing are fixed to the rotary shafts respectively adjacent one another; and synchronization gears are attached to the rotation shafts respectively to mesh one another, at least one of the synchronization gears being made of plastic material; whereby torque transmission between the rotary shafts is carried out in two ways, via the magnetic drive disks without contact between the magnets and via the synchronization gears meshing one another.

The invention also proposes as an oil-free fluid machine equipped with the drive transmission mechanism a fluid machine having a rotor casing and two or more lobed rotors accommodated in the rotor casing rotatably to expel gas trapped in pockets formed between the lobes and the rotor casing as the rotors rotate; wherein magnetic drive disks, each being composed of a magnet carrier disk made of nonmagnetic material and having a plurality of magnets arranged on the magnet carrier disk circumferentially at equal spacing, are fixed to rotor shafts of the rotors respectively adjacent one another; and synchronization gears are attached to the rotor shafts of the rotors respectively to mesh each other, at least one of the synchronization gears being made of plastic material; whereby torque transmission between the rotors is carried out in two ways, via the magnetic drive disks without contact between the magnets and via the synchronization gears meshing one another.

By composing as mentioned above the drive transmission mechanism such that magnetic drive disks each consisting of a magnet carrier disk made of nonmagnetic material and a plurality of magnets arranged on one side face of the magnet carrier disk circumferentially at equal spacing are attached to rotary shafts respectively at one side end thereof and synchronization gears are attached to the rotary shafts at the other end side thereof respectively, a part of torque transmission is done via the magnetic drive disks and the remaining torque transmission is done via the synchronization gears. Therefore, load torque exerting on the synchronization gears is reduced, and plastic gear or gears can be adopted for the synchronization gears, resulting in requiring no lubricant to lubricate the synchronization gears and prolonged operation life of the synchronization gears. Therefore, by adopting the drive transmission mechanism in an oil-free fluid machine, contamination with lubricating oil can be eliminated, and particularly a dry mechanical vacuum pump of high efficiency which can produce oil-free vacuum can be provided.

It is preferable that the synchronization gears are fixed at an end side of each rotary shaft respectively and the magnetic drive disks are fixed to the other end side of each rotary shaft respectively. By providing the magnetic drive disks and the synchronization gears at both end sides of the rotary shafts respectively, torque transmission between the rotary shafts is performed at both end sides of the rotary shafts, and well-balanced torque transmission is carried out.

By providing the synchronization gears in a side opposite to a side where a drive device is connected to one of the rotary shafts, replacement of synchronization gears when they have worn is facilitated.

By attaching the plurality of magnets on one side surface of the magnetic drive disks respectively, and fixing the magnetic drive disks to the rotary shafts respectively such that the magnets of respective driving disks face each other with a small gap maintained between the magnets as the driving disks rotate, torque transmission capacity is increased, since the gap between the magnets facing one another can be reduced to a minimum.

As has been described in the foregoing, according to the drive transmission mechanism of the invention, as torque transmission between the rotary shafts is carried out in two ways, via the magnetic drive disks and via the synchronization gears, load torque exerting on the synchronization gears is reduced, and plastic gear or gears can be adopted for the synchronization gears, resulting in requiring no lubricant to lubricate the synchronization gears and prolonged operation life of the synchronization gears. Therefore, by adopting the drive transmission mechanism in an oil-free fluid machine, contamination with lubricating oil can be eliminated, and particularly a dry mechanical vacuum pump of high efficiency which can produce oil-free vacuum can be provided.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1A:
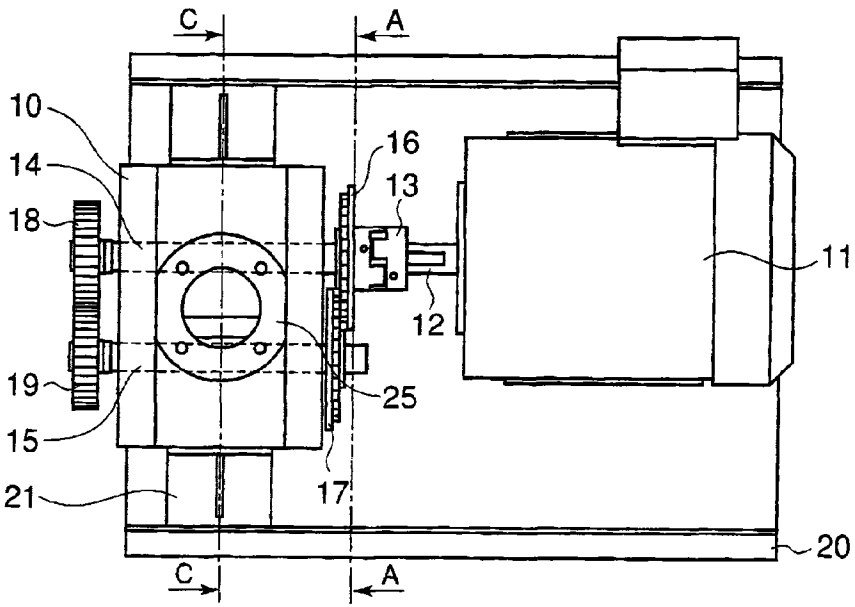
FIG. 1A is a plan view of the oil-free fluid machine composed as a dry mechanical vacuum pump of roots type equipped with the drive transmission mechanism according to the present invention.
Figure 1B:
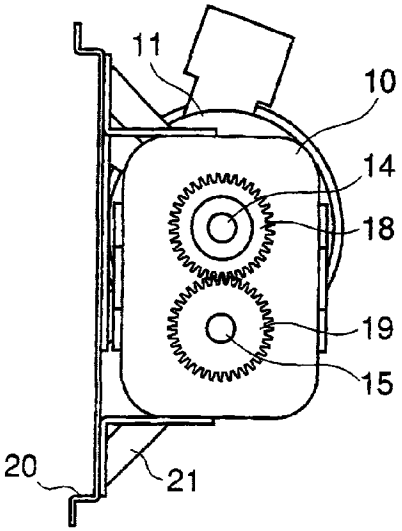
FIG. 1B is a front view thereof.
Figure 1C:
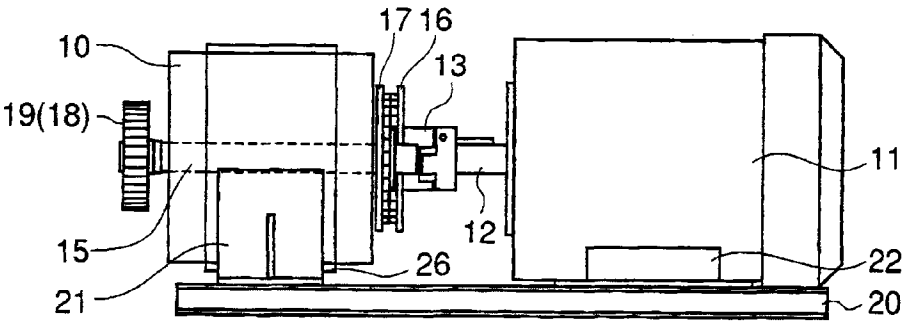
FIG. 1C is a side view thereof.

FIG. 1A is a plan view of the oil-free fluid machine composed as a dry mechanical vacuum pump of roots type equipped with the drive transmission mechanism according to the present invention, FIG. 1B is a front view thereof, and FIG. 1C is a side view thereof. FIG. 2A is a sectional view along line A-A in FIG. 1A, and FIG. 2B is a cross sectional view along Line C-C in FIG. 1A.

Although the invention will be explained taking up as an example a dry mechanical vacuum roots pump of two rotors equipped with the drive transmission mechanism, the drive transmission mechanism of the invention can be applied to any of fluid machines having two or more counter-rotating meshed lobed rotors accommodated in a rotor casing parallel to one another to be rotated in synchronization with one another and torque transmission between the rotors is performed under unlubricated condition, so applicable also to screw vacuum pumps and claw vacuum pumps.

Figure 2B:
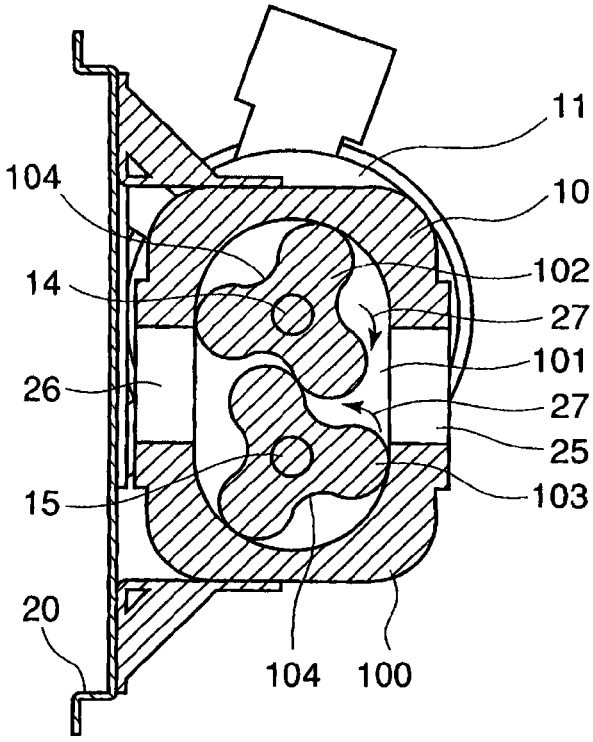
FIG. 2B is a cross sectional view along Line C-C in FIG. 1A.
Figure 2A:
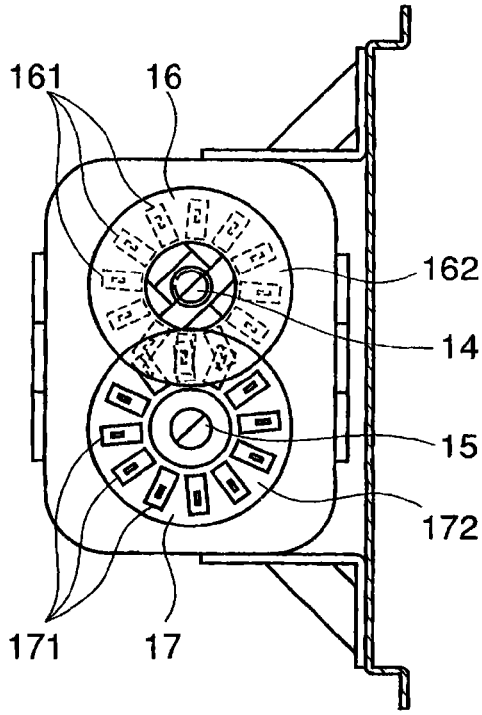
FIG. 2A is a sectional view along line A-A in FIG. 1A.

Referring to FIGS. 1-3, reference numeral 10 is a dry mechanical vacuum roots pump, 11 is a drive motor for driving the vacuum pump 10, 12 is a driving shaft of the drive motor 11. Reference numeral 13 is a coupling for connecting the driving shaft 12 of the drive motor 11 to an end of a rotary shaft 14 of the vacuum pump, 15 is the other rotary shaft. Reference numeral 16 and 17 are magnetic drive disks attached to the rotary shaft 14 and 15 respectively. Each of the magnetic drive disks 16 and 17 is composed of a magnet carrier disk 162 and 172, and a plurality of magnets 161 and 171 attached on one side surface of each of magnet carrier disks 162, 172 at equal circumferential spacing. The driving plates 16 and 17 are fixed to the rotary shaft 14 and 15 so that the magnets do not contact to each other but face with a certain gap when the magnets come to face each other by the rotation of the rotary shaft 14 and 15. Driving torque of the drive motor 11 transmitted to the magnetic drive disk 16 by means of the coupling 13 is transmitted to the magnetic drive disk 17 via the magnetic force of the magnets as explained later. The magnet carrier disks 162 and 172 are made of nonmagnetic material such as aluminum, copper, stainless steel, and plastics. Reference numerals 18 and 19 are synchronization gears attached to the other end of the rotary shafts 14 and 15 respectively meshing with each other to allow synchronized rotation of the rotary shafts 14 and 15 in direction opposite to each other. Reference numeral 20 is a mounting base for supporting the vacuum pump 10 and the drive motor 11. Reference numerals 21 and 22 are fixing means for fixing the vacuum pump 10 and the drive motor 11. Reference numerals 25 and 26 (see FIG. 2B) are an outlet port and intake port respectively.

As shown in FIG. 2B, a pair of three-lobes roots type rotors 102 and 103 are accommodated in a pump chamber 101 of a rotor casing 100. The rotors 102 and 103 are integrated respectively with the rotary shafts 14 and 15 which are supported to be parallel to one another by oil less bearings not shown in the drawings. The rotors 102 and 103 can be rotated without contact between lobe surfaces thereof and also without contact between the peripheries of the lobes and the wall surface of the pump chamber 101.

Fluid such as air is trapped in pockets 104 surrounding the lobes and carried from the intake port 26 side to the outlet port 25 side and expelled from there as the rotors 102 and 103 rotate as shown by arrows 27 in FIG. 2B.

Returning to FIGS. 1A, B, C, the vacuum pump 10 is fixed to the mounting base 20 by means of the fixing means 21, and the driving shaft 12 of the motor 11 also fixed to the mounting base 20 by means of the fixing means 22 is connected to the rotary shaft 14 by means of the coupling 13. The magnetic drive disk 16 composed of the magnetic carrier disk 162 made of nonmagnetic material such as aluminum, copper, stainless steel, and plastics and a plurality of magnets arranged on one side surface thereof, is fixed to the rotary shaft 14 at the motor 11 side end thereof. To the other side end of the rotary shaft 14 is fixed the gear 18.

As is the magnetic drive disk 16, the magnetic drive disk 17 is fixed to the rotary shaft 15 provided parallel to the rotary shaft 14, and a plurality of magnets 171 are arranged on one side surface of the magnetic carrier disk 172 made of nonmagnetic material such that the magnets 171 do not contact to the magnets 161 attached to the magnetic carrier disk 162 when the magnets on the magnetic drive disks 16 and 17 face each other by the rotation of the rotary shafts 14 and 15. To the other side end of the rotary shaft 15 is fixed the gear 19 to mesh with the gear 18.

At least one of the gears 18 or 19 is made of plastics, and the other gear is made of plastics or metal. By using the plastic gear, lubricant for lubricating the meshing gears can be dispensed with. As shown in FIG. 2A, the plurality of magnets 161 and 171 are attached to the magnet carrier disks 162 and 172 on one side surface of each of the magnet carrier disks 162 and 172 respectively at equal circumferential spacing.

Figure 3B:
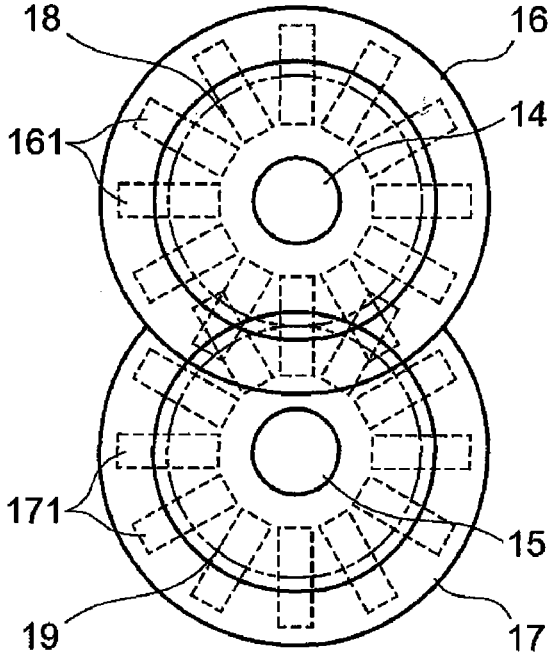
FIG. 3B is a view of the magnetic driving mechanism viewed from the synchronizing gears side.
Figure 3A:
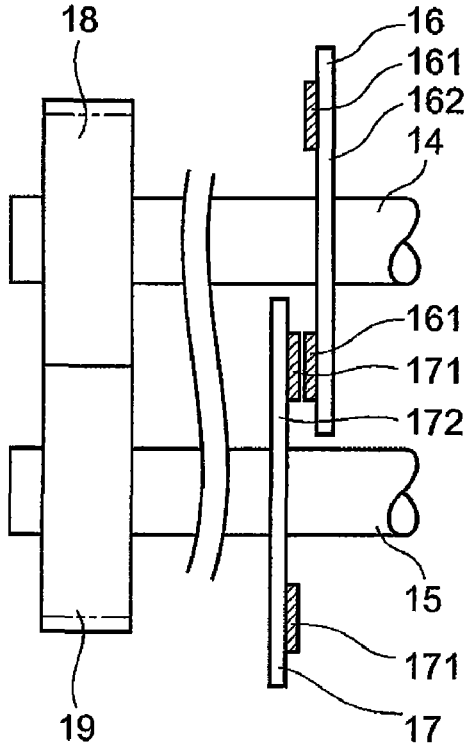
FIG. 3A is a side elevational view showing the magnetic drive transmission mechanism.

FIG. 3 is a side elevational view showing the magnetic drive transmission mechanism, and FIG. 3B is a view of the magnetic driving mechanism viewed from the synchronizing gears 18 and 19 side, in which the vacuum pump part is omitted for convenience' sake of explanation. It can be seen in FIG. 3A that the magnet 161 and 171 are attached to one side surface of each of the magnet carrier disks 162 and 172 respectively and the magnetic drive disks 16 and 17 are fixed to the rotary shafts 14 and 15 respectively so that a gap is maintained between the magnet 161 and magnet 171.

As can be seen in FIGS. 3A and 3B, the magnetic drive disks 16 and 17 are fixed to the rotary shafts 14 and 15 respectively such that the magnets 161 of the magnetic drive disk 16 face the magnets 171 of the magnetic drive disk 17 with a gap maintained between the magnets 161 and 171 sequentially as the rotary shaft 14 and 15 rotates in counter direction to each other.

As the gear 18 attached to the rotary shaft 14 at its end opposite to the magnetic drive disk 16 meshes with the gear 19 attached to the rotary shaft 15 at its end opposite to the magnetic drive disk 17, the rotary shaft 14 and 15 rotate in counter direction to each other. When the magnetic drive disk 16 fixed to the rotary shaft 14 is rotated by the drive motor 11, the magnetic drive disk 17 is rotated in the counter direction by interaction between the magnets 161 and 171 as explained later, so when the rotary shaft 14 is driven by the drive motor 11, the driving torque is transmitted to the rotary shaft 15 via the magnetic drive disks 16, 17 and via the synchronization gears 18, 19. As mentioned before, at least one of the gears 18 or 19 is made of plastics, and the other gear is made of plastics or metal, and by using plastic gear, lubricant for lubricating the meshing gears can be dispensed with.

Figure 4A:
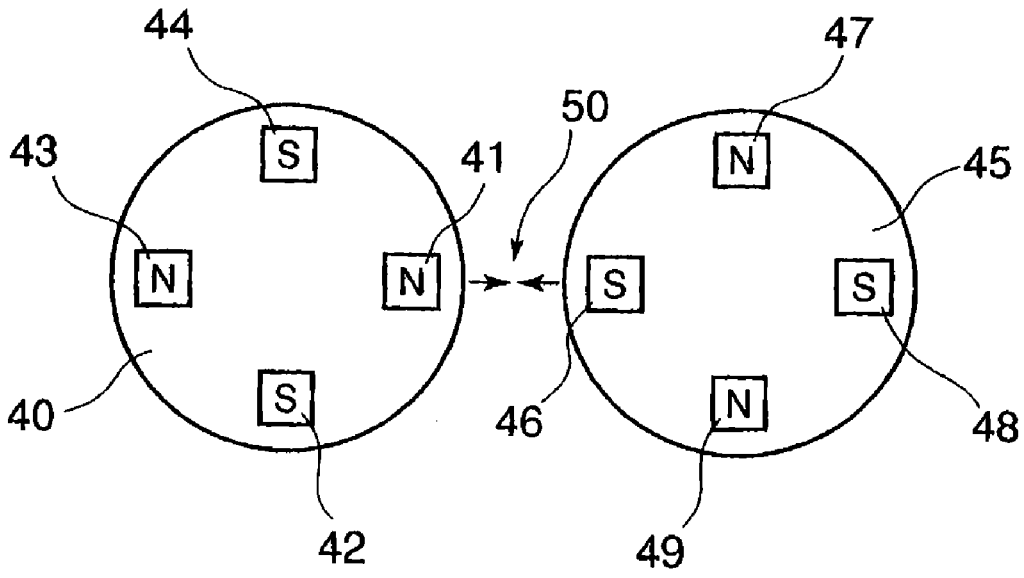
FIGS. 4A and 4B are conceptual diagrams for explaining drive transmission by means of a pair of magnetic drive disks.
Figure 4B:
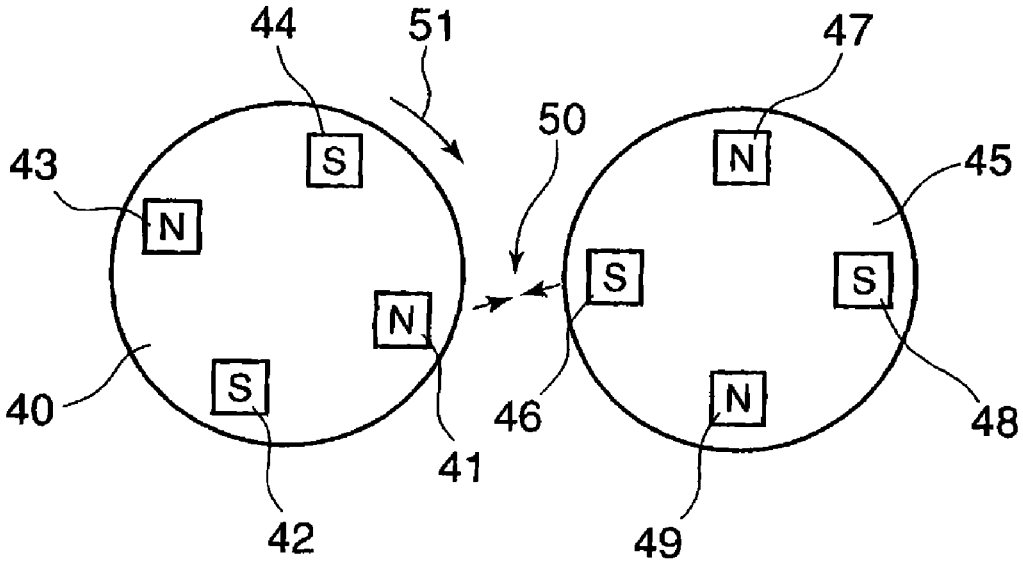

FIGS. 4A and 4B are conceptual diagrams for explaining drive transmission by means of a pair of magnetic drive disks 16 and 17. The magnets are arranged so that N-poles and S-poles lie side-by side with each other circumferentially at equal spacing. Now, we think a state magnetic poles N41, S42, N43, and S44 are arranged on the magnetic carrier disk 40 alternately circumferentially at equal spacing and magnetic poles S46, N47, S48, and N49 are arranged on the magnetic carrier disk 45 alternately circumferentially at equal spacing, and the magnetic pole N41 faces the magnetic pole S46 as shown in FIG. 4A for example. In this state, the poles N41 and S46 are attracting one another as indicated by an arrow 50.

In this state, when the drive disk 40 is rotated by the drive motor 11 in the direction of an arrow 51 as shown in FIG. 4B, the pole S46 is dragged by the pole N41 to be rotated in counter direction. When rotation resistance of the drive disk 45 is large and the drive disk 45 can not keep pace of rotation to the rotation of the drive disk 40, then the pole S44 of the drive disk 40 comes closer to the pole S46 of the drive disk 45 and the drive disk 45 is further rotated by the repelling force between the poles S44 and S46. Thus, the drive disk 45 is rotated in counter direction as the drive disk 40 is rotated without contact between both drive disks.

The smaller the gap between the magnets 41~44 and 46~49 is, the stronger the rotation driving force between the magnetic drive disk 40 and the magnetic drive disk 45 is.

Therefore, as shown in FIGS. 2A and 3A, by fixing the magnetic drive disks 16 and 17 to the rotary shafts 14 and 15 respectively such that the magnets 161 and 171 face directly with a small gap sequentially as the magnetic drive disks 16 and 17 rotate, the magnetic force can be effectively utilized and strong rotation driving force can be obtained.

However, torque to drive the rotary shaft 17 is large, a slip occurs between the rotation of both drive disks and synchronized counter rotation of both drive disks can not be achieved.

Therefore, according to the present invention the synchronization gears 18 and 19 are provided, and torque transmission from the rotary shaft 14 to the rotary shaft 15 is mainly done via the magnetic drive disks 16 and 17. For example, about 70% of the torque transmission is done via the magnetic drive disks 16 and 17 and about 30% is done via the synchronization gears 18 and 19.

According to the drive transmission mechanism of the invention, synchronized counter rotation of two or more rotors (rotary shafts) can be maintained with decreased load to the synchronization gears, and it is possible to adopt a plastic gear for at least one of the synchronization gears without reducing operation life of the synchronization gears and without a need of using lubrication oil to lubricate the synchronization gears. Thus, by adopting a plastic gear in the drive transmission mechanism composed like this, problems of reduced torque transmission capacity by use of plastic gears and poor endurance against mechanical load of plastic gears can be solved together.

According to the oil-free fluid machine equipped with the drive transmission mechanism, contamination with lubricating oil is eliminated, friction loss of oil seals is eliminated, and performance of oil-free fluid machines such as dry mechanical vacuum pumps can be increased. As the synchronization gears 18 and 19 are provided in the opposite side of the drive motor 11, replacement of the plastic gear is easy when it wears of fractures.

As has been described in the forgoing, by composing the drive transmission mechanism to transmit torque from a rotary shaft 14 to a rotary shaft 15 such that magnetic drive disks 16, 17 each consisting of a magnet carrier disk 162 or 172 made of nonmagnetic material and a plurality of magnets 161, 171 arranged on one side face of the magnet carrier disk circumferentially at equal spacing are attached to the rotary shafts 14, 15 respectively at one end side thereof and synchronization gears 18, 19 are attached to the rotary shafts at the other end side thereof respectively, a part of torque transmission is done via the magnetic drive disks and the remaining torque transmission is done via the synchronization gears. Therefore, load torque exerting on the synchronization gears is reduced, and plastic gear or gears can be adopted for the synchronization gears, resulting in requiring no lubricant to lubricate the synchronization gears and in prolonged operation life of the synchronization gears.

Therefore, by adopting the drive transmission mechanism in an oil-free fluid machine, contamination with lubricating oil can be eliminated, and particularly a dry mechanical vacuum pump of high efficiency which can produce oil-free vacuum can be provided.

According to the invention, drive transmission mechanism increased in torque transmission capacity and longevity without a need of using lubrication oil is provided, and by adopting the drive transmission mechanism in a vacuum pomp, an oil contamination free vacuum pump can be provided.

The invention claimed is:

1. A drive transmission mechanism for transmitting torque between two or more parallel rotary shafts a first one of the parallel rotary shafts having a coupling affixed thereto for directly coupling the first shaft to a motor drive shaft, said drive transmission mechanism comprising:

at least one magnetic drive disk affixed to each of the rotary shafts, each magnetic drive disk being comprised of a magnet carrier disk made of nonmagnetic material and having a plurality of magnets arranged on the magnet carrier disk circumferentially at equal spacing, wherein the at least one magnetic drive disk affixed to the first one of the parallel rotary shafts partially overlaps the at least one magnetic drive disk affixed to another of the parallel rotary shafts; and synchronization gears attached to the rotation shafts respectively to mesh with one another, at least one of the synchronization gears being made of plastic material;

whereby torque transmission between the rotary shafts is carried out in two ways, via the magnetic drive disks without contact between the magnets and via the synchronization gears meshing with one another.

2. A drive transmission mechanism according to claim 1, wherein said synchronization gears are fixed at an end side of each rotary shaft respectively and said magnetic drive disks are fixed to the other end side of each rotary shaft respectively.

3. A drive transmission mechanism according to claim 1, wherein said synchronization gears are provided in a side opposite to a side where a drive device is connected to one of the rotary shafts.

4. A drive transmission mechanism according to claim 1, wherein each of said magnetic drive disks has said plurality of magnets attached on one side surface thereof.

5. A drive transmission mechanism according to claim 1, wherein said magnetic drive disks are fixed to the rotary shafts respectively such that the magnets of respective driving disks face each other with a small gap maintained between the magnets as the driving disks rotate.

6. An oil-free fluid machine having a rotor casing and two or more lobed-rotors accommodated in the rotor casing rotatably to expel gas trapped in pockets formed between the lobes and the rotor casing as the rotors rotate, said machine comprising:

magnetic drive disks, each being composed of a magnet carrier disk made of nonmagnetic material and a plurality of magnets arranged on the magnet carrier disk circumferentially at equal spacing, are fixed to a rotor shafts extending from each of the rotors such that the magnetic carrier disk mounted on one of the rotors partially overlaps the magnetic carrier disk mounted on another one of the rotors; and synchronization gears attached to the rotor shafts of the rotors respectively to mesh with each other, at least one of the synchronization gears being made of plastic material;

whereby torque transmission between the rotors is carried out in two ways, via the magnetic drive disks without contact between the magnets and via the synchronization gears meshing with one another.

* * * * *